US008734206B2

(12) United States Patent
Chang et al.

(10) Patent No.: US 8,734,206 B2
(45) Date of Patent: May 27, 2014

(54) POLISHING PAD FOR CHEMICAL MECHANICAL POLISHING PROCESS AND CHEMICAL MECHANICAL POLISHING APPARATUS INCLUDING THE SAME

(75) Inventors: One-Moon Chang, Yongin-si (KR); Jae-Phil Boo, Seongnam-si (KR); Soo-Young Tak, Suwon-si (KR); Jong-Sun Ahn, Hwaseong-si (KR); Shin Kim, Hwaseong-si (KR); Kyoung-Moon Kang, Gwangmyeong-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 513 days.

(21) Appl. No.: 13/036,496

(22) Filed: Feb. 28, 2011

(65) Prior Publication Data

US 2011/0217911 A1 Sep. 8, 2011

(30) Foreign Application Priority Data

Mar. 3, 2010 (KR) ..... 10-2010-0019170

(51) Int. Cl.
*B24B 1/00* (2006.01)

(52) U.S. Cl.
USPC ..... 451/285; 451/286; 451/527

(58) Field of Classification Search
CPC ..... B24D 13/147; B24D 18/0009
USPC ..... 451/526, 527, 529, 539, 285, 286, 287
See application file for complete search history.

(56) References Cited

U.S. PATENT DOCUMENTS

| | | | | |
|---|---|---|---|---|
| 6,547,651 | B1 * | 4/2003 | Boyd et al. | 451/285 |
| 6,699,115 | B2 * | 3/2004 | Osterheld et al. | 451/527 |
| 6,749,485 | B1 * | 6/2004 | James et al. | 451/41 |
| 6,843,711 | B1 * | 1/2005 | Muldowney | 451/527 |
| 7,121,938 | B2 | 10/2006 | Suzuki | |
| 7,140,955 | B2 * | 11/2006 | Nabeya | 451/287 |
| 7,267,610 | B1 * | 9/2007 | Elmufdi et al. | 451/530 |
| 7,329,174 | B2 * | 2/2008 | Hosaka et al. | 451/527 |
| 7,357,703 | B2 * | 4/2008 | Nishimura et al. | 451/527 |
| 8,057,282 | B2 * | 11/2011 | Muldowney | 451/41 |
| 8,123,597 | B2 * | 2/2012 | Chiu et al. | 451/527 |
| 8,287,793 | B2 * | 10/2012 | Deopura et al. | 264/299 |
| 8,398,461 | B2 * | 3/2013 | Wang | 451/41 |
| 2002/0137450 | A1 * | 9/2002 | Osterheld et al. | 451/527 |
| 2003/0153250 | A1 * | 8/2003 | Boyd et al. | 451/41 |
| 2005/0130561 | A1 * | 6/2005 | Ina | 451/5 |
| 2005/0260929 | A1 | 11/2005 | Shiho et al. | |
| 2008/0207100 | A1 * | 8/2008 | Roy et al. | 451/529 |

FOREIGN PATENT DOCUMENTS

| | | | |
|---|---|---|---|
| JP | 2005-118996 | A | 5/2005 |
| JP | 2006-005339 | A | 1/2006 |
| KR | 10 2006-00460 | A | 5/2006 |
| KR | 10 2008-01136 | A | 12/2008 |

* cited by examiner

*Primary Examiner* — George Nguyen
(74) *Attorney, Agent, or Firm* — Lee & Morse, P.C.

(57) ABSTRACT

A chemical mechanical polishing apparatus includes a platen configured to support and rotate a wafer, and a polishing pad facing the platen. The polishing pad includes a body having a groove with a rotational symmetric pattern.

11 Claims, 7 Drawing Sheets

POLISHING PAD FOR CHEMICAL MECHANICAL POLISHING PROCESS AND CHEMICAL MECHANICAL POLISHING APPARATUS INCLUDING THE SAME

BACKGROUND

1. Field

Exemplary embodiments relate to a polishing pad for a chemical mechanical polishing process of planarizing a wafer used as a substrate or a layer formed on the wafer, and a chemical mechanical polishing apparatus including the same.

2. Description of the Related Art

As semiconductor devices gain a higher degree of integration and higher capacity, a step difference of a material layer formed on a semiconductor substrate, for example, a metal interconnection, is increasing. Due to the step difference of the metal interconnection, it can be difficult to pattern the metal interconnection. Particularly, since the step difference between a cell region and a peripheral region in a memory device is increased, as the height of the metal interconnection increases, the problem of step difference becomes more serious. Thus, a technique for planarizing a material layer or a semiconductor substrate is essential for fabricating a semiconductor device.

SUMMARY

Embodiments are therefore directed to a polishing pad for a chemical mechanical polishing process and a chemical mechanical polishing apparatus including the same.

Exemplary embodiments provide a polishing pad for a chemical mechanical polishing process capable of more easily controlling a slurry provided on a wafer for a polishing process and a chemical mechanical polishing apparatus including the same.

It is to be understood that both the foregoing general description and the following detailed description are example and explanatory and are intended to provide further explanation of the inventive concept as claimed.

In accordance with an exemplary embodiment, a polishing apparatus for a chemical mechanical polishing process includes a body having a groove with a rotational symmetric pattern.

The groove may have a width of about 0.4 mm to about 0.8 mm.

The rotational symmetric pattern may have a pitch of about 1.8 mm to about 2.5 mm.

The groove may have a depth of about 0.7 mm or more, which is less than a thickness of the body.

The rotational symmetric pattern may have several concentric circles.

The rotational symmetric pattern may include a first pattern of several concentric circles, and a second pattern with a radial shape which crosses the first pattern.

The second pattern may have grooves, which are spaced apart from each other and have a predetermined length.

The rotational symmetric pattern may be a swirl shape diverging to the left or right.

The rotational symmetric pattern may include a circular groove disposed in the middle thereof.

In accordance with another exemplary embodiment, a chemical mechanical polishing apparatus includes a platen configured to support and rotate a wafer and a polishing pad facing the platen and including a body having a groove with a rotational symmetric pattern.

The chemical mechanical polishing apparatus may further include a pad head having the polishing pad attached thereto, and rotating and moving the polishing pad. In addition, the chemical mechanical polishing apparatus may further include a slurry provider configured to provide a slurry on a surface of one side of the wafer.

The groove may have a width of about 0.4 mm to about 0.8 mm.

The groove may have a depth of about 0.7 mm or more, which is less than a thickness of the body.

The rotational symmetric pattern may have a pitch of about 1.8 mm to about 2.5 mm.

The rotational symmetric pattern may have a swirl shape diverging to the left or right.

The diverging direction of the swirl shape may correspond to a rotation direction of the polishing pad.

The rotational symmetric pattern may include a first pattern with the swirl shape and a second pattern with a radial shape which crosses the first pattern.

The rotational symmetric pattern may include a first pattern with the swirl shape and a second pattern of several concentric circles, which crosses the first pattern.

A body of the polishing pad may have a groove with the rotational symmetric pattern in a side facing the platen. A surface of the side facing the platen may be parallel to a surface of the wafer.

The rotational symmetric pattern may have a pitch of about 1.8 mm to about 2.5 mm, and the groove may have a width of about 0.4 mm to about 0.8 mm, and a depth of about 0.7 mm or more which is less than a thickness of the body.

BRIEF DESCRIPTION OF THE DRAWINGS

Features will become more apparent to those of ordinary skill in the art by describing in detail exemplary embodiments with reference to the attached drawings, in which.

DETAILED DESCRIPTION

Figure 1:
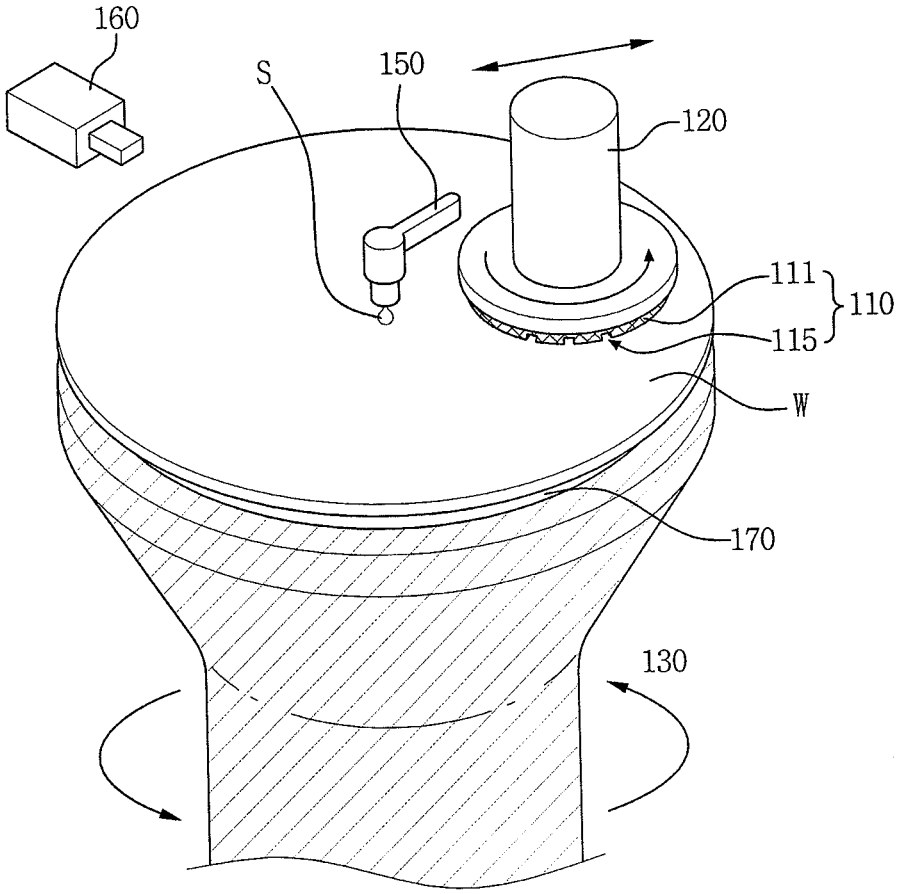
FIG. 1 illustrates a schematic perspective view of a chemical mechanical polishing apparatus according to an exemplary embodiment.

Korean Patent Application No. 10-2010-0019170, filed on Mar. 3, 2010, in the Korean Intellectual Property Office, and entitled: "Polishing Pad for Chemical Mechanical Polishing Process and Chemical Mechanical Polishing Apparatus Including the Same," is incorporated by reference herein in its entirety.

Various embodiments will now be described more fully with reference to the accompanying drawings in which some embodiments are shown. Embodiments may, however, be embodied in different forms and should not be construed as limited to the exemplary embodiments set forth herein. Rather, these exemplary embodiments are provided so that this disclosure is thorough and complete and fully conveys the inventive concept to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present embodiments.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the present embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In a process of fabricating a semiconductor device, an exemplary planarizing technique, for example, a chemical mechanical polishing (CMP) process, is provided to planarize a surface of a wafer or a material layer formed on the wafer by a combination of a mechanical polishing effect by a polishing agent and a chemical reaction effect by an acid or base solution.

EXEMPLARY EMBODIMENTS

FIG. 1 is a schematic perspective view of a chemical mechanical polishing apparatus according to an exemplary embodiment.

Referring to FIG. 1, a chemical mechanical polishing apparatus according to the exemplary embodiment comprises a platen 130 supporting a wafer W and rotating the wafer W. A polishing pad 110 disposed on the platen 130 and including a body 111 having a groove 115 with a predetermined pattern is also included.

Here, the chemical mechanical polishing apparatus according to the exemplary embodiment may include a pad head 120 to which the polishing pad 110 is attached and which rotates the polishing pad 110. A slurry provider 150 providing a slurry S on the wafer W may be included.

The polishing pad 110 is in contact with a surface of one side of the wafer W at a predetermined pressure to polish the wafer W. The body 111 of the polishing pad 110 may be formed in a matrix of polyurethane having a higher frictional strength than the wafer W. Here, the polyurethane refers to a polymer compound formed by urethane bonding between an alcoholic group and an isocyanate group.

The groove 115 formed in the body 111 allows the slurry S to be uniformly applied between the polishing pad 110 and the wafer W. Thus, the groove 115 of the polishing pad 110 has a uniform pattern.

Here, the polishing pad 110 is rotated at a predetermined rate by the pad head 120, and in contact with the wafer W. Thus, the groove 115 of the polishing pad 110 formed in the body 111 has a rotational symmetric pattern.

In the polishing pad 110, the groove 115 is disposed on a surface of the body 111 facing the platen 130, that is, a surface facing the wafer W. Here, the surface of the wafer W needs to be uniformly polished by the body 111 of the polishing pad 110. Thus, the surface facing the wafer W of the body 111 may be parallel to the surface of the wafer W.

The pad head 120 rotates the polishing pad 110 to uniformly polish the wafer W with the polishing pad 110. Here, the polishing pad 110 may have a smaller size than the wafer W. Accordingly, the pad head 120 may be provided to rotate and move the polishing pad 110 back and forth along a diameter of the wafer W.

The platen 130 supports and rotates the wafer W during a polishing process. A rotation direction of the wafer W by the platen 130 may be opposite to the rotation direction of the polishing pad 110 by the pad head 120. The platen 130 and the pad head 114 may also rotate the wafer W and the polishing pad 110 in the same direction.

Here, the chemical mechanical polishing apparatus according to the exemplary embodiment may further include a membrane 170 of a predetermined thickness disposed between the platen 130 and the wafer W. The membrane 170 may protect and/or prevent the wafer W from being damaged by the platen 130.

The platen 130 may include one or more vacuum holes (not shown) connected with a vacuum pump (not shown). Here, the membrane 170 disposed between the platen 130 and the wafer W may be formed of a porous material.

The membrane 170 may include one or more holes corresponding to the vacuum holes.

The vacuum holes (not shown) may reduce, minimize, and/or prevent the lifting of an edge of the wafer W. To this end, the vacuum holes may be disposed in an edge of the platen 130.

The slurry provider 150 may provide the slurry S on the wafer W. Here, the slurry S is a solution in which nano power particulates for mechanical polishing are uniformly dispersed, and an acid or base solution for a chemical reaction with the wafer W is dispersed into and mixed with distilled water and ultrapure water.

The chemical mechanical polishing apparatus according to the exemplary embodiment may further include a detector 160 measuring a degree of polishing of the wafer W. Here, the detector 160 may include an end point detector (EPD) sensor.

Figure 2A:
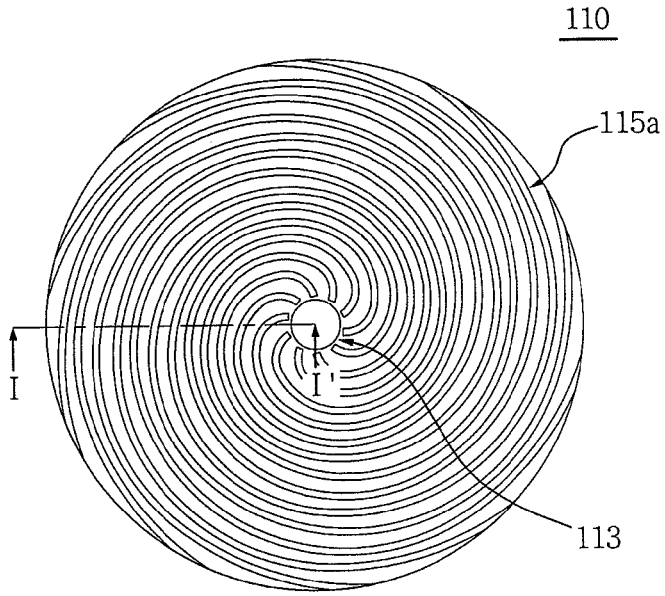
FIGS. 2A and 2B illustrate plan views of a first type of a polishing pad for a chemical mechanical polishing process included in a chemical mechanical polishing apparatus according to an exemplary embodiment.
Figure 2B:
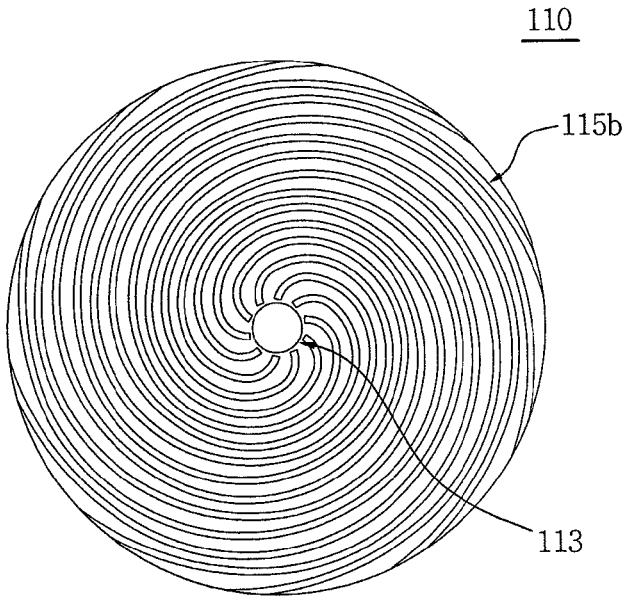

FIGS. 2A and 2B are plan views of a first type of a polishing pad for a chemical mechanical polishing process included in a chemical mechanical polishing apparatus according to an exemplary embodiment.

Referring to FIGS. 2A and 2B, a polishing pad 110 for a chemical mechanical polishing process according to an exemplary embodiment may have grooves 115*a* and 115*b* with a swirl pattern diverging to the left or right.

In the chemical mechanical polishing apparatus according to the exemplary embodiment, the polishing pad 110 may rotate in the same direction as the swirl pattern. That is, the polishing pad 110 may rotate in the same direction as the direction in which the swirl pattern diverges. Due to such a swirl pattern, the polishing pad 110 may hold more of a slurry.

Thus, when the polishing pad 110 rotates faster than the wafer W, the grooves 115*a* and 115*b* with the swirl pattern may more easily control flow of the slurry S. Here, the wafer W may rotate in an opposite direction to the polishing pad 110, that is, in an opposite direction to the direction in which the swirl pattern diverges.

Figure 2C:
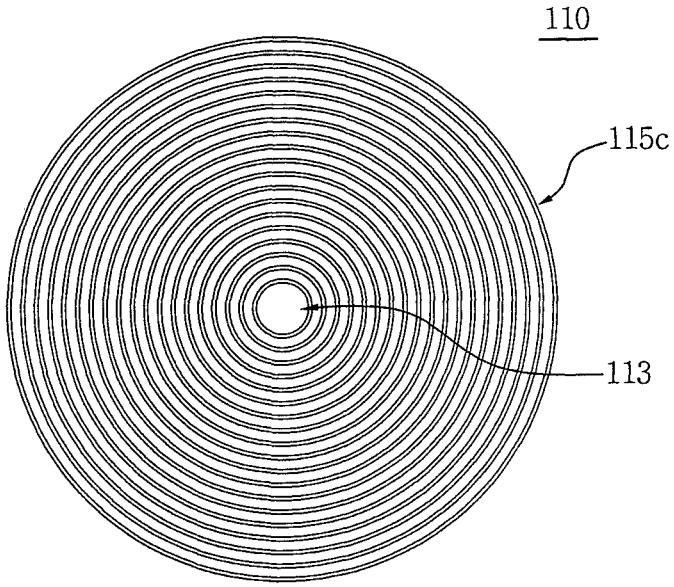
FIG. 2C illustrates a plan view of a second type of a polishing pad for a chemical mechanical polishing process included in a chemical mechanical polishing apparatus according to an exemplary embodiment.

FIG. 2C is a plan view of a second type of a polishing pad for a chemical mechanical polishing process included in a chemical mechanical polishing apparatus according to an exemplary embodiment.

Referring to FIG. 2C, a polishing pad 110 for a chemical mechanical polishing process according to the exemplary embodiment may have a groove 115*a* in a pattern having several concentric circles. The pattern having several concentric circles is provided to hold a predetermined amount of a slurry S therein.

Thus, the groove 115*a* formed in the pattern having several concentric circles may uniformly provide the slurry S to the polishing pad 110.

Figure 2D:
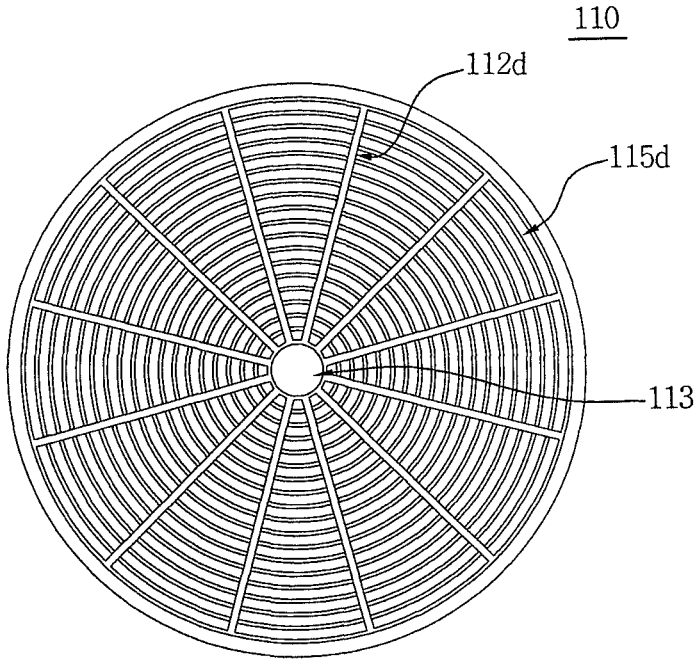
FIGS. 2D and 2E illustrate plan views of a third type of a polishing pad for a chemical mechanical polishing process included in a chemical mechanical polishing apparatus according to an exemplary embodiment.
Figure 2E:
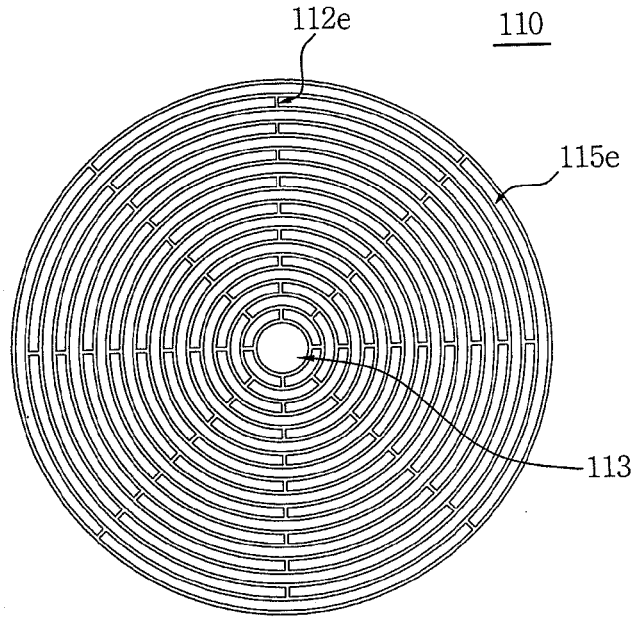

FIGS. 2D and 2E are plan views of a third type of a polishing pad for a chemical mechanical polishing process included in a chemical mechanical polishing apparatus according to an exemplary embodiment.

Referring to FIGS. 2D and 2E, a polishing pad 110 for a chemical mechanical polishing process according to the exemplary embodiment may include a groove 115*b* formed in a first pattern having several concentric circles, and a groove 112*b* formed in a radial second pattern which crosses the first pattern.

The groove 112*b* formed in the second pattern may generate the flow of external air between the wafer W and the polishing pad 110. That is, the groove 112*b* may allow a boundary of the polishing pad 110 to open to facilitate inward and outward flow of the slurry S. In addition, the groove 112*b* may reduce and/or prevent vacuum adhesion between the polishing pad 110 and the wafer W by rotatory power.

Here, in the polishing pad 110, as shown in FIG. 2E, the radial second pattern may have several grooves 112*e*, which are spaced apart from each other and have predetermined lengths.

Figure 2F:
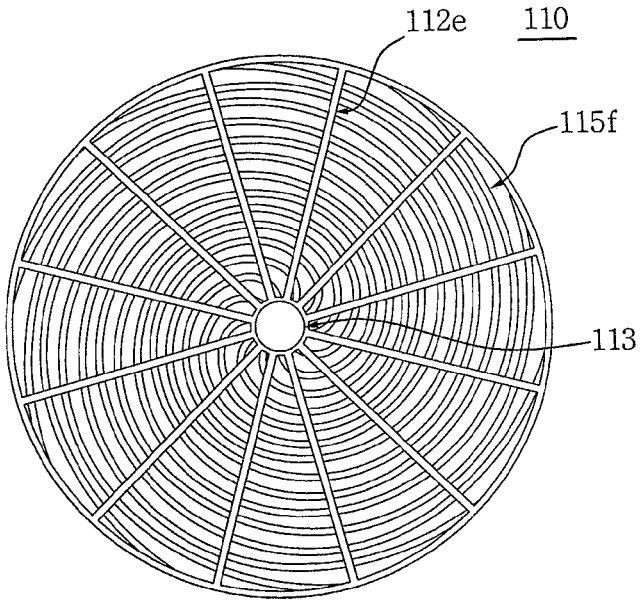
FIGS. 2F and 2G illustrate plan views of a fourth type of a polishing pad for a chemical mechanical polishing process included in a chemical mechanical polishing apparatus according to an exemplary embodiment.
Figure 2G:
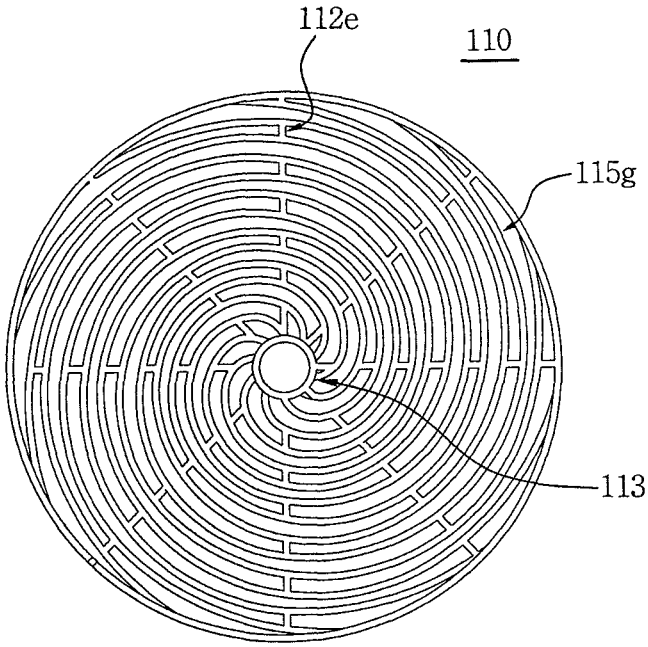

FIGS. 2F and 2G are plan views of a fourth type of a polishing pad for a chemical mechanical polishing process included in a chemical mechanical polishing apparatus according to an exemplary embodiment.

Referring to FIGS. 2F and 2G, a polishing pad 110 for a chemical mechanical polishing process according to the exemplary embodiment may include a groove 115*f* formed in a swirl pattern as shown in FIG. 2A, and a groove 112*f* formed in a radial pattern as shown in FIG. 2D.

Here, as shown in FIG. 2G, the radial pattern may have several grooves 112*g* spaced apart from each other and having predetermined lengths.

The polishing pad 110 for a chemical mechanical polishing process included in a chemical mechanical polishing apparatus according to the exemplary embodiment, as shown in FIGS. 2A to 2G, may further include a circular groove 113 in the middle thereof. Without intending to be bound by this theory, the circular groove 113 may be provided to facilitate flow of a slurry S to and from the polishing pad 110.

While not shown in the drawing, the polishing pad for a chemical mechanical polishing process included in the chemical mechanical polishing apparatus according to the exemplary embodiment may include a groove formed in a swirl pattern and a groove formed in a pattern having concentric circles.

The polishing pad for a chemical mechanical polishing process included in the chemical mechanical polishing apparatus according to the exemplary embodiment may have a groove in any other type of rotational symmetric pattern not shown in any of FIGS. 2A through 2G.

As a result, the polishing pad 110 for a chemical mechanical polishing process included in the chemical mechanical polishing apparatus according to the exemplary embodiment includes a body having a groove with a rotational symmetric pattern. Without intending to be bound by this theory, the groove 115 with the rotational symmetric pattern may be provided to uniformly apply the slurry S between the polishing pad 110 and the wafer W, so as to improve polishing efficiency.

Figure 3:
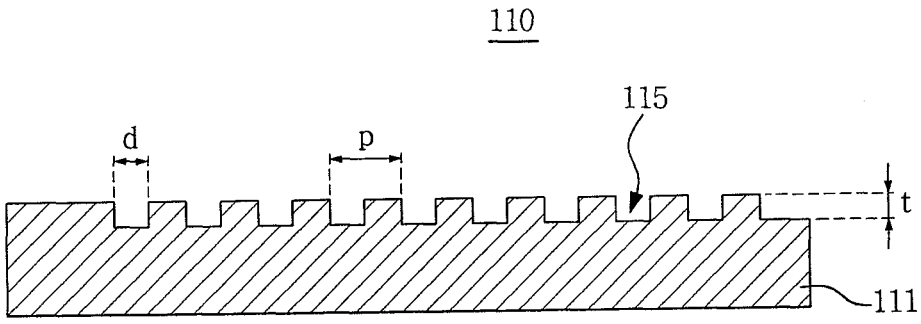
FIG. 3 illustrates a cross-sectional view taken along line I-I' of FIG. 2A.

FIG. 3 is a cross-sectional view taken along line I-I' of FIG. 2A, illustrating a polishing pad for a chemical mechanical polishing process according to an exemplary embodiment.

Referring to FIG. 3, a groove 115 of a polishing pad 110 for a chemical mechanical polishing process according to the exemplary embodiment has a predetermined width d and depth t, while a rotational symmetric pattern has a predetermined pitch p.

Without intending to be bound by this theory, when the groove 115 of the polishing pad 110 has a very small width d, the groove 115 may be blocked by impurities such as pad wastes or polishing by-products. When the groove 115 has a very large width d, the slurry S flowed to the polishing pad 110 is rapidly exhausted. In addition, when the width d of the groove 115 becomes larger, an area of the polishing pad 110 contributing to polishing the wafer W is decreased. When the area of the polishing pad 110 is decreased, a polishing rate of the polishing pad 110 is also decreased.

Table 1 shows layer removal rates (RR) according to the width d of the groove 115 formed in the body 111 of the polishing pad 110. Here, the layer removal rate RR represents a thickness of a layer removed in each cycle of a process. Thus, a unit of the layer removal rate RR is Å/cycle. Time for each process may be about 40 seconds. In addition, Table 1 shows values measured three times according to the same width d of the groove 115.

TABLE 1

| d | 0.2 mm | | | 0.4 mm | | | 0.6 mm | | |
|---|---|---|---|---|---|---|---|---|---|
| RR | 101 | 109 | 113 | 142 | 145 | 139 | 143 | 146 | 148 |
| d | 0.8 mm | | | 1.0 mm | | | 1.2 mm | | |
| RR | 147 | 176 | 150 | 117 | 121 | 122 | 113 | 114 | 108 |

Figure 4:
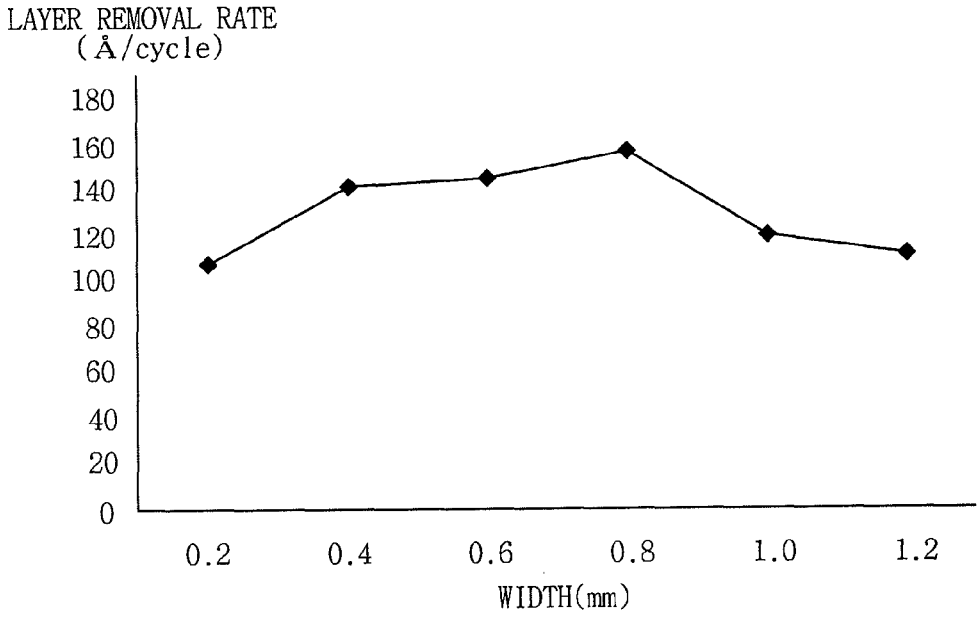
FIG. 4 illustrates a graph of layer removal rates according to a width of a groove of a polishing pad.

FIG. 4 is a graph illustrating Table 1. Here, FIG. 4 shows an average value of the measured value for a width d of each groove 115.

Referring to Table 1 and FIG. 4, when the width d of the groove 115 formed in the body 111 of the polishing pad 110 is 0.2 mm or less, the layer removal rate (RR) becomes lower. This is because the inflow of the slurry S is not smoothly performed, such that the layer removal rate RR is decreased.

It can be seen that when the width d of the groove 115 is 1.2 mm or more, the layer removal rate RR becomes lower. This is because the slurry S outflows rapidly, such that the layer removal rate RR is decreased.

On the other hand, it can be seen that when the width d of the groove 115 formed in the body 111 of the polishing pad 110 is 0.4 mm to 0.8 mm, the layer removal rate RR becomes higher. This is because the flow of the slurry S to and from the groove 115 of the polishing pad 110 is suitably performed, such that the layer removal rate RR is increased.

Thus, the groove 115 of the polishing pad 110 for a chemical mechanical polishing process according to the exemplary embodiment may have a width of about 0.4 mm to about 0.8 mm.

Without intending to be bound by this theory, when the groove 115 of the polishing pad 110 has a pattern having a very small pitch p, it may be difficult to flow the slurry between the wafer W and the wafer pad 110. When the groove 115 has a pattern having a very high pitch p, an area of the body 111 of the polishing pad 110 contributing to polishing may be decreased. Due to the decrease in the area of the body 111, a polishing rate of the polishing pad 110 is decreased.

Table 2 shows layer removal rates RR according to a pitch p of a rotational symmetric pattern of a groove formed in a polishing pad. Here, the layer removal rate RR represents a thickness of the layer removed in each cycle of a process. Thus, a unit of the layer removal rate RR is Å/cycle. Time for each process may be about 40 seconds. In addition, Table 2 shows values measured twice according to the pitch p of the same pattern.

TABLE 2

| P | 1.5 mm | | 1.8 mm | | 2.5 mm | | 2.7 mm | |
|---|---|---|---|---|---|---|---|---|
| RR | 158 | 157 | 215 | 214 | 224 | 221 | 167 | 170 |

Figure 5:
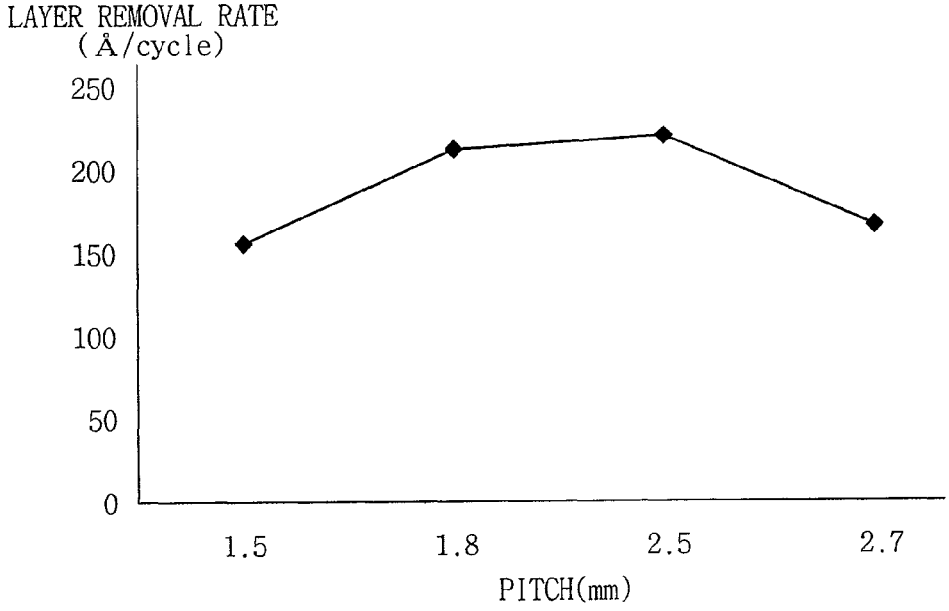
FIG. 5 illustrates a graph of layer removal rates according to a pitch of a groove pattern of a polishing pad.

FIG. 5 is a graph illustrating FIG. 2. FIG. 5 illustrates average values of measured values for the pitch p of each pattern.

Referring to Table 2 and FIG. 5, when the groove 115 formed in the body 111 of the polishing pad 110 has a pitch p of 1.5 mm or less, the layer removal rate RR becomes lower. This is because as an area of the body 111 of the polishing pad 110 contributing to the polishing process is decreased, the layer removal rate RR is also decreased. In addition, the decrease in area of the body 111 may excessively increases a pressure applied to the wafer W. When the pressure applied to the wafer W is increased, non-uniform polishing may occur. The non-uniform polishing may leave an undesirable pattern excluding the groove 115 formed in the polishing pad 110 on the wafer W, resulting in, e.g., defects.

When the groove 115 has a pitch of 2.7 mm or more, the layer removal rate RR becomes lower. This is because as the area of the body 111 of the polishing pad 110 is increased, the flow of the slurry through the groove 115 of the body 111 is not smoothly performed. When the flow of the slurry S is not smoothly performed, the slurry S may not be uniformly applied between the wafer W and the polishing pad 110.

In addition, when the area of the body 111 of the polishing pad 110 contributing to the polishing process is increased, a requisite pressure applied to the wafer W may be decreased. That is, the decrease in the requisite pressure decreases the layer removal rate RR.

On the other hand, it can be seen that when the groove 115 of the polishing pad 110 has a pitch p of about 1.8 mm to about 2.5 mm, the layer removal rater RR becomes higher.

Thus, in the polishing pad 110 for a chemical mechanical polishing process according to the exemplary embodiment, the groove 115 of the body 111 may be designed in a rotational symmetric pattern having a pitch p of about 1.8 mm to about 2.5 mm.

Figure 6A:
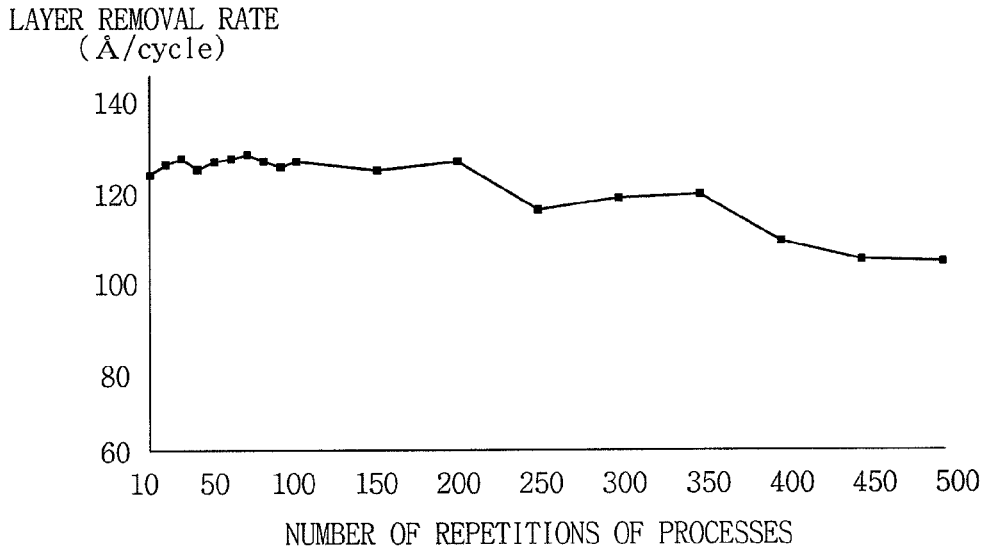
FIG. 6A illustrates a graph of layer removal rates according to the number of repetitions of a process when a groove of a polishing pad has a depth of about 0.6 mm.
Figure 6B:
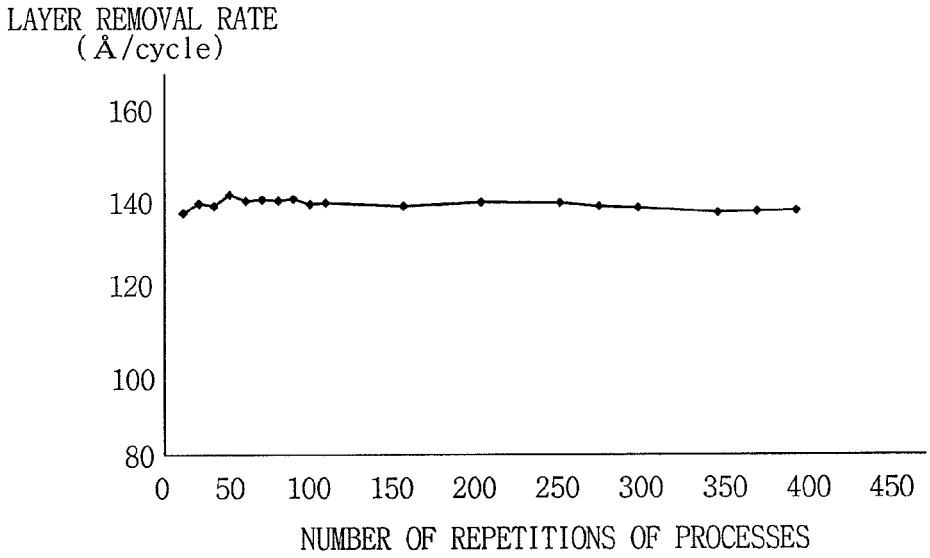
FIG. 6B illustrates a graph of layer removal rates according to the number of repetitions of a process when a groove of a polishing pad has a depth of about 0.7 mm.

FIG. 6A is a graph of layer removal rates (RR) according to the number of repetitions of a polishing process when the groove 115 of the polishing pad 110 has a depth t of 0.6 mm. FIG. 6B is a graph of a layer removal rate (RR) according to the number of repetitions of a polishing process when the groove 115 of the polishing pad 110 has a depth t of 0.7 mm. Here, a unit of the layer removal rate RR is Å/cycle. Time for each process may be about 40 seconds.

Referring to FIG. 6A, when the depth t of the groove 115 of the polishing pad 110 is 0.6 mm or less, the layer removal rate RR is rapidly decreased after 200 cycles of polishing processes.

Referring to FIG. 6B, when the depth t of the groove 115 of the polishing pad 110 is 0.7 mm or less, there is no significant change in the layer removal rate RR even after the 400 cycles of polishing processes.

Thus, in the polishing pad 110 for a chemical mechanical polishing process according to the exemplary embodiment, the depth t of the groove 115 may be designed to be about 0.7 mm or more. The depth t of the groove 115 may be at least about 0.7 mm and less than a thickness of the body.

In addition, without intending to be bound by this theory, as the depth t of the polishing pad 110 becomes higher, the polishing pad 110 may hold more of a slurry S, resulting in improvement in polishing efficiency. However, when the groove 115 of the polishing pad 110 has a depth t higher than the thickness of the body 111 of the polishing pad 110, it is difficult to maintain the shape and pattern of the groove 115. In addition, a pattern generated by the groove 115 in the body 111 of the polishing pad 110 crumbles due to a pressure applied in the polishing process.

Accordingly, in the polishing pad 110 for a chemical mechanical polishing process according to the exemplary embodiment, the groove 115 may be designed to have a depth t of about 0.7 mm or more, which is less than the thickness of the body 111.

As a result, in the polishing pad for a chemical mechanical polishing process and the chemical mechanical polishing apparatus having the same according to the exemplary embodiment, the polishing pad disposed on the wafer includes a groove with a rotational symmetric pattern. Thus, the slurry may be uniformly applied between the wafer and the polishing pad.

In addition, in the polishing pad for a chemical mechanical polishing process, a predetermined pattern of the groove has a pitch of about 1.8 mm to about 2.5 mm. The groove of the polishing pad may have a width of about 0.4 mm to about 0.8 mm. The groove of the polishing pad has a depth t of about 0.7 mm or more, which is less than the thickness of the polishing pad. Accordingly, the slurry may be uniformly applied between the wafer and the polishing pad, and the groove and pattern of the polishing pad may be maintained.

According to the exemplary embodiments, without intending to be bound by this theory, a polishing pad for a chemical mechanical polishing process and a chemical mechanical polishing apparatus having the same may more easily control a slurry provided on a wafer to be uniformly applied and maintained between the wafer and the polishing pad. Thus, the polishing pad for a chemical mechanical polishing process and the chemical mechanical polishing apparatus having the same may, e.g., maximize a layer removal rate and efficiency of the polishing pad.

The foregoing is illustrative of embodiments and is not to be construed as limiting thereof. Although a few embodiments have been described, those skilled in the art will readily appreciate that many modifications are possible in embodiments without materially departing from the novel teachings and advantages. Accordingly, all such modifications are intended to be included within the scope of this inventive concept as defined in the claims. In the claims, means-plus-function clauses are intended to cover the structures described herein as performing the recited function, and not only structural equivalents but also equivalent structures. Therefore, it is to be understood that the foregoing is illustrative of various embodiments and is not to be construed as limited to the specific embodiments disclosed.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A polishing pad for a chemical mechanical polishing process, the polishing pad comprising:

a body including a first groove with a rotational symmetric pattern, and a circular groove disposed in a center of the rotational symmetric pattern of the first groove, wherein the first groove has a width of 0.4 mm to 0.8 mm, and wherein the rotational symmetric pattern of the first groove is a swirl shape diverging in a same direction as a direction in which the polishing pad rotates.

2. The polishing pad as claimed in claim 1, wherein the rotational symmetric pattern has a pitch of about 1.8 mm to about 2.5 mm.

3. The polishing pad as claimed in claim 2, wherein the first groove has a depth of at least about 0.7 mm and less than a thickness of the body.

4. The polishing pad as claimed in claim 1, wherein the body further includes a second groove with a rotational symmetric pattern, the rotational symmetric pattern of the second groove is a radial shape that crosses the first groove.

5. A chemical mechanical polishing apparatus, comprising:

a platen configured to support and rotate a wafer; and a polishing pad facing an upper surface of the platen, the polishing pad including a body having a first groove with a rotational symmetric pattern, and a circular groove disposed in a center of the rotational symmetric pattern of the first groove, wherein the first groove has a width of about 0.4 mm to about 0.8 mm, and wherein the rotational symmetric pattern of the first groove is a swirl shape, and the diverging direction of the rotational symmetric pattern of the first groove is a same direction as a rotation direction of the polishing pad.

6. The apparatus as claimed in claim 5, further comprising:

a pad head having the polishing pad attached thereto and configured to rotate and move the polishing pad; and a slurry provider configured to provide a slurry on a surface of one side of the wafer.

7. The apparatus as claimed in claim 5, wherein the first groove has a depth of at least about 0.7 mm and less than a thickness of the body.

8. The apparatus as claimed in claim 5, wherein the rotational symmetric pattern has a pitch of 1.8 mm to 2.5 mm.

9. The apparatus as claimed in claim 5, wherein, the body further has a second groove with a rotational symmetric pattern which crosses the first groove.

10. The apparatus as claimed in claim 9, wherein the rotational symmetric pattern of the second groove is a radial shape formed by grooves that are spaced apart from each other and have a predetermined length.

11. The apparatus as claimed in claim 5, wherein the rotational symmetric pattern of the first groove has a pitch of about 1.8 mm to about 2.5 mm, and a width of about 0.4 mm to about 0.8 mm, and a depth of at least about 0.7 mm and less than a thickness of the body.

* * * * *